United States Patent [19]

Faessel et al.

[11] Patent Number: 4,518,660

[45] Date of Patent: May 21, 1985

[54] SHAPED BLANKS, METHODS FOR THEIR PRODUCTION AND IMPROVEMENTS TO THE UNIVERSAL ROLLING OF RAILS

[75] Inventors: André Faessel, Saint-Nicolas en Foret-Hayange; Gabriel B. Mennel, Nilvange; Jacques M. Michaux, Joeuf, all of France

[73] Assignee: Sacilor, France

[21] Appl. No.: 435,967

[22] Filed: Oct. 22, 1982

[30] Foreign Application Priority Data

Nov. 4, 1981 [FR] France ..... 81 20689

[51] Int. Cl.[3] ..... B21B 1/08; B21B 13/08

[52] U.S.Cl. ..... 428/577; 72/225; 72/234; 72/366; 238/122; 428/583

[58] Field of Search ..... 428/577, 583, 585, 581; 238/125, 122, 130, 150, 126, 148; 72/225, 366, 222, 221, 226, 229

[56] References Cited

U.S. PATENT DOCUMENTS

| | | | |
|---|---|---|---|
| 499,651 | 6/1893 | Butz | 72/225 |
| 657,964 | 9/1900 | Seaman | 72/225 X |
| 1,306,967 | 6/1919 | Mathias | 238/125 |
| 3,583,193 | 6/1971 | Kishikawa | 72/225 |
| 4,344,310 | 8/1982 | Kozono et al. | 72/225 |

FOREIGN PATENT DOCUMENTS

| | | | |
|---|---|---|---|
| 141925 | 6/1935 | Fed. Rep. of Germany | 238/122 |
| 1960601 | of 1968 | Fed. Rep. of Germany . | |
| 685350 | of 1930 | France . | |
| 1447939 | of 1966 | France . | |
| 2000306 | of 1969 | France . | |
| 2346063 | of 1977 | France . | |
| 37200 | of 1959 | Luxembourg . | |

*Primary Examiner*—Francis S. Husar
*Assistant Examiner*—Steven B. Katz
*Attorney, Agent, or Firm*—Bacon & Thomas

[57] ABSTRACT

The primary blank 1, which is to be transformed into a finished rail by means of universal passes, edging passes and a finishing pass, is characterized by a symmetric 'Y' section the thickness of which always varies in the same way. It is designed to be shaped exclusively in open grooves.

This primary blank 1 is roughed in a specific manner in a universal stand and undergoes a strong forging which improves the quality of the finished rail. A secondary blank is then formed which has a special shape allowing the production by universal rolling of a very accurate profile of the finished rail.

19 Claims, 11 Drawing Figures

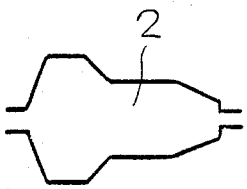
Fig-4
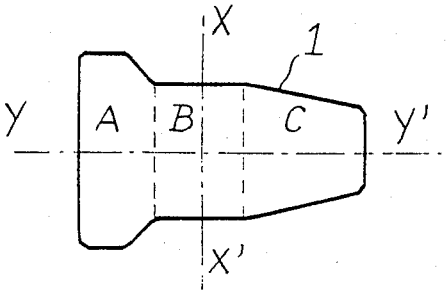
Fig-5
Fig-6
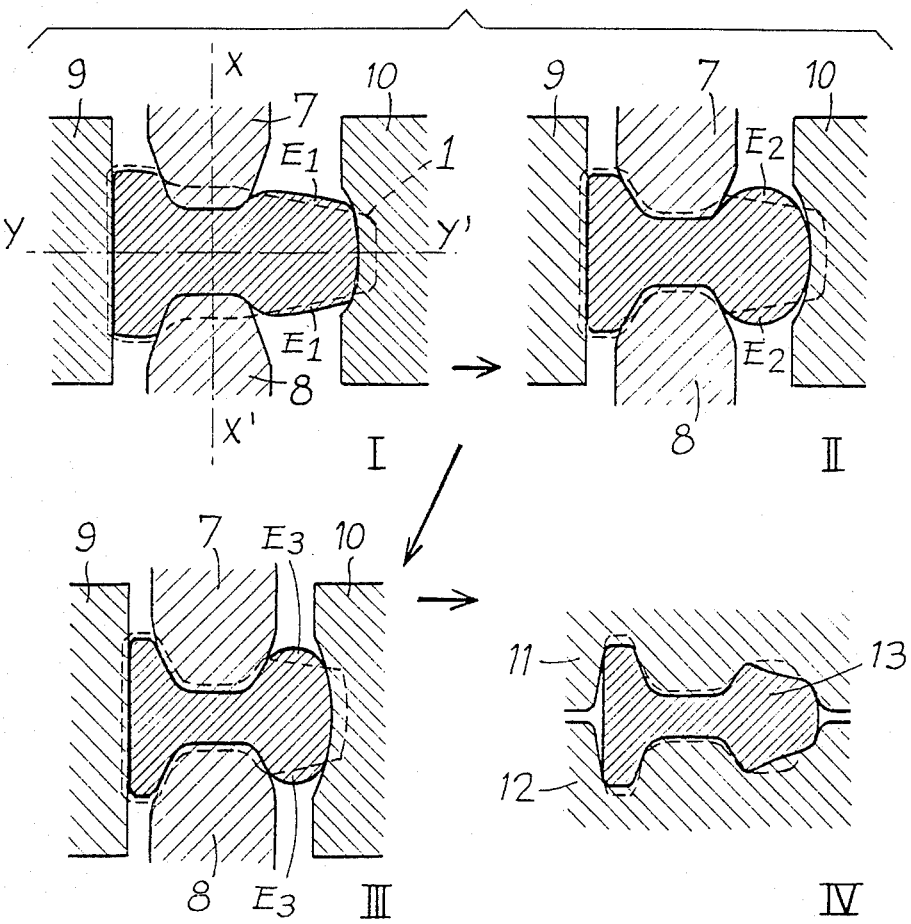

SHAPED BLANKS, METHODS FOR THEIR PRODUCTION AND IMPROVEMENTS TO THE UNIVERSAL ROLLING OF RAILS

The invention relates to the manufacture, by universal rolling, of rails for railway tracks, overhead cranes and other similar types of rails.

The universal rolling of rails according to French Patent No. 1,447,939 (corresponding to the U.S. Pat. No. 3,342,053) can be divided into two phases. The purpose of the first phase is to prepare by conventional rolling a primary blank which will be transformed into a finished rail by universal rolling of the second phase. The preparation of the primary blank in the first phase is generally made on two heavy-duty, two-high breakdown stands, in six to eight passes. Starting from a rectangular bloom (a) (FIG. 1) the single blank (b) is progressively formed in so-called rolling or open grooves (c) to (e) (FIG. 3), closed grooves (f) to (h) and an open groove (i). According to the definition of W. TAFEL (Theory and Practice of Rolling Steel—Penton Publishing Co, Cleveland, Ohio, 1927), a groove is open or rolling when the angle formed by the joints of the groove with the axis of the cylinder is less than 60°. The shape of the blank (b) is, though larger, similar (FIG. 1) to the shape of the finished rail which is represented by the hatched area. The part of the single blank (b) which will form the head (ch) of the finished rail, has an elongate curved shape terminating in a rounded region which will form the tread (tr) of the head of the rail; the part that is to form the web (am) of the finished rail is deeply cut in and that which is to form the foot (pa) of the finished rail has a shape which is close to the corresponding fishing slopes of the foot of the finished rail.

In universal rolling, as practised by the Applicants according to the prior art, of a rail having a weight per linear meter of 60 Kg, starting with a bloom having a weight per linear meter of about 550 Kg, the reduction ratio, from the bloom (a) to the finished rail, is of the order of 9.2. The reduction ratio of the first phase, that is to say that of the breaking down by conventional rolling of the bloom (a) to form the single blank (b) is of the order of 3.7. The reduction ratio of the second phase, that is to say of the universal rolling of the single blank (b) to produce the finished rail, is of the order of 2.5. In the second phase, in the state-of-the-art process, the single blank (b) is rolled with alternate edging and control of the spread to maintain always the curvature of the head during the successive deformations of the blank, in combining the rolling in a universal stand, between four rolls, with the rolling in a two-high edging stand, in such manner that the spreading effected by one universal pass should be suppressed by a subsequent edging pass, to avoid the formation of swelling on the sides of the head.

The disadvantage of the prior art results from the shape given to the single blank (b), the constituent masses of which are practically in proportion to those of the finished rail. Because it comprises very marked parts, which will ultimately become the head, the web and the foot of the rail, the single blank (b) can only be formed progressively, in practice part by part. Such necessary progressiveness involves the disadvantage of multiplying the number of grooves. Since it is not generally possible to locate all the required grooves in the rolls of a single breakdown stand, which is usually a two-high stand, it is necessary to install or to use two breakdown stands. The stands required are massive and costly, as well as their rolls.

Since it is not possible with a single set of two pairs of rolls (or 4 rolls in all for the two, two-high breakdown stands), to prepare and shape all the single blanks (b) for all the rail profiles produced by the mill, it is necessary to have several sets of pairs of breakdown rolls, not to mention the necessary spare rolls, which involves maintaining a considerable stock of rolls. Moreover the breakdown passes f to h (FIG. 3) made in closed grooves that limit the spread of the product by means of the side faces of the groove, generate substantial groove wear. For example, for universal rolling of a rail in which the single blank (b) is shaped in the first phase with eight passes made in a non-universal mill to be transformed into a finished rail in the second phase by universal rolling with six or seven passes (universal or edging passes), the roll consumption, expressed in Kg of roll per tonne produced of finished rail, is of the order of 0.840 Kg/tonne for the shaping of the single blank (b) in the first non-universal phase, which is 0.105 Kg/tonne on average per pass, and of the order of 0.210 Kg/tonne in the second, universal phase, which is 0.035 Kg/tonne on average per pass, that is to say three times less. Though the average-per-pass consumption figures cannot be considered to exactly reflect the reality for each pass, the order of magnitude of three times less consumption per pass in the second, universal phase, clearly shows the disadvantages of the first, non-universal phase. The lower wear of the passes of the second universal phase results from the fact that these passes are all made in open grooves. Because of its shape the single blank (b) cannot be formed exclusively in open grooves. Some closed grooves are necessary.

Up to now, blooms (a) were produced from ingots. The overall reduction ratio from the ingot to the finished rail, varying according to local conditions, was generally much greater than the minimum deemed up to now to be desirable for metallurgical reasons, this minimum reduction ratio being of the order of 20 for rails rolled by the conventional method in which the rolling is essentially effected in closed grooves in which the forging effect on the head and the foot of the rail is slight, when compared with that in universal rolling. The ingot way is actually being gradully abandoned in favour of continuous casting, which is more economic and allows the direct production of blooms (a). The continuous casting process however involves certain disadvantages which are inherent in the process, in the technology of its application and in the economics of its operation. The compromises that have to be made to reduce the investment and operating costs are the cause of certain disadvantages which can be critical so far as the production of rails is concerned. A continuous casting process can only deliver a limited number of bloom dimensions. Continuous cast blooms arrive generally at the rail rolling mill with their solidification structure, contrarily to blooms produced from ingots, the solidification structure of which has been considerably modified by earlier rolling in a blooming mill. It is known that the overall reduction ratio $$\frac{\text{ingot section}}{\text{finished rail section}}$$

of a rail made from metal produced by the ingot route is in general comprised between 70 and 80. For rails rolled from a bloom produced by continuous casting, it is generally accepted that the overall reduction ratio may be of about 15. The optimisation of the economics of continuous casting and also the inherent metallurgical limitations of continuous casting scarcely permit increasing the overall reduction ratio above 15. As the overall reduction ratio is independent of the method used for rolling the rails, it is not possible to increase its value. This being so, one can contemplate the reduced ratio being compensated for by the quality of the draught, especially of the draught applied upon the head and the foot of the rail.

Non-universal rolling does not allow any improvement in the quality of the draught applied on the parts of the section that are to form the foot and the head. Universal rolling according to the prior art, with its reduction ratio of about 2.5, applied during the second phase with direct draught, that is to say the universal phase, already improves to a certain extent the quality of forging of all parts of the rails, especially of the foot and the head. It would be desirable with the universal rail rolling to increase the part of the reduction ratio made with direct draught, but it is not possible in the prior art method, because of the shape of the single blank (b) which requires closed grooves (f) to (h) (FIG. 3) that work the metal predominantly by indirect draught in the parts of the rail which need the most to be rolled by direct draught, namely the head and the foot. Increasing the section of the single blank (b) to increase the part of the reduction ratio made by direct draught in the second phase of universal rolling of the rails would not bring about any noticeable improvement, because this would lead to increase the section of the bloom (a) which cannot, in the present state of the technique of continuous casting, be increased above a certain limit for metallurgical reasons related to solidification. On the other hand, continuous casting does not allow the direct production of a single blank (b) of a section such that it can be transformed into a finished rail with an overall reduction ratio of 15 achieved solely by direct draught with the universal rolling of the second phase.

The invention has for its object to avoid, as the case may be, all or part of the disadvantages resulting from the shape of the single blank (b), with two new shapes for rail blanks for universal rolling, allowing:

starting from a bloom (a) obtained from an ingot or by continuous casting, to reduce, on the one hand, the number of grooves in the first, non-universal phase and, on the other hand, to eliminate completely the use of closed grooves;

from the beginning to the end of the rolling process, the rolling of the metal by direct draught to improve, by a stronger forging, the quality of the rails produced and, in the case of continuous cast metal, to compensate for the reduced overall reduction ratio by an improved quality of draught applied exclusively by direct pressure;

to increase the part played by universal rolling in the overall reduction ratio, to improve the quality of the draught applied upon parts of the rail such as the head and the foot, direct production by continuous casting of one of them and, consequently, its full rolling by universal rolling;

to reduce the number of stands required for the first, non-universal phase, or even to eliminate them completely;

economies in guide, tackles and rolls.

The objects of the invention are achieved by a primary blank, made directly by continuous casting or obtained by the breaking down of a bloom, either produced by continuous casting or from an ingot, the primary blank being defined in that:

it has substantially plane faces, adjacent faces being connected by curves;

it is symmetrical with respect to a longitudinal plane, said plane of symmetry being also that of the finished rail;

a section substantially in the form of a T that can be divided for purposes of the description and functionally into three parts:

the first, polygonal part comprising five plane faces two of which are parallel to the plane of symmetry and one is perpendicular thereto, the planes containing the two other faces cutting the plane of symmetry at equal angles;

the second part, preferably of rectangular section, contiguous with the first part comprising two faces preferably parallel to the plane of symmetry, said faces being eventually marked with a lengthwise imprint intended to facilitate guidance of the primary blank as it enters the first universal pass;

the third part, of trapezoidal section, contiguous with the second part, comprising three faces, one face being perpendicular to the plane of symmetry, the planes containing the other two faces cutting the plane of symmetry at equal angles.

a variation in the thickness of the section, from one end to the other, being made always in the same way, that is to say increasing or decreasing according to which end you start from.

The invention also concerns a method for initially forming a bloom which can be rectangular or which has already been pre-shaped, in an open groove, with the aim of producing the primary blank as above defined.

The invention also concerns the further rolling of said primary blank, namely a primary universal roughing, with one or more passes, of the primary blank, without edging passes, with strong reduction and high elongation, in working mainly the first and third parts, in the direction of the axis of symmetry of the section of the primary blank in order to forge them strongly and deeply, to break up and destroy the solidification structure of the metal, while rounding off the face at the free end of the third part with the aid of a vertical roller having a special shape, while favouring an expansion of the other two faces of the third part so as to round them off.

Advantageously, the profile given to the active part of the vertical roll on the head-side is defined by one (or more than one) polynomial form.

Said form is such that it corresponds respectively to the one and other branch of the cubic parabola of the solid equal resistance inscribed in the depth of the groove of the vertical roll less the radius of the outer edge of the groove and in the half height of the groove less the flat bottom part of the groove.

The method of the invention is advantageously followed by a secondary forming of a secondary blank, in an open groove, with one or more passes, with the application of significant reduction over all parts of the rolled shape except for the tread surface of the head and the underside of the foot.

Advantageously, the process is conceived to produce a secondary blank, formed from the bar resulting from the primary universal roughing, the masses of which practically correspond to those of the finished rail, and which differs from the single blank (b) of the state of the art by:

swellings where the flanks of the head join the upper fishing slopes, concave flanks of the head a tread surface of flattened form a section that is closer to that of the finished rail.

The process comprising the secondary forming can be followed by a conventional universal rolling of the secondary blank and provide therewith an improved universal rail rolling process comprising:

when the bloom is already preformed, or is of a rectangular section, a primary phase of forming a primary blank, a phase of primary universal roughing of the primary blank, a secondary phase of forming a secondary blank, a phase of rolling the secondary blank by the universal method according to the prior art, to produce the finished rail.

The characteristics of the invention will be better understood with the following description of the preferred embodidments. The description refers to the annexed drawings in which:

FIGS. 1 and 2 show comparatively:

FIG. 1: in the prior art method of universal rolling, the profile (a) of the initial section called bloom, the profile (b) of the prior art single blank, the hatched section of the finished rail, the axis of symmetry of the finished rail being designated by YY' and its neutral axis by XX'.

FIG. 2: according to the present invention, the profile of the bloom (a), the profile of the primary blank 1 according to the invention, the hatched section of the finished rail, and the profile of the secondary blank 13 of the invention.

FIGS. 3 and 4 show comparatively:

FIG. 3: in the prior art method of universal rolling, the breaking down of a not represented bloom (a) of appropriate initial section, to form the single blank (b) of the prior art.

FIG. 4: according to the present invention, the groove 2 for forming the primary blank 1 from a not shown appropriate initial section either rectangular or preformed.

FIG. 5 shows the section of the primary blank 1 subdivided into three parts A, B and C for the purpose of description.

FIG. 6 shows schematically the primary universal roughing according to the invention, in three passes, I to III, as well as the pass IV of the secondary forming according to the invention, of the secondary blank 13 of the invention.

In order to achieve the set objectives, the primary blank 1 of the invention (FIGS. 5 and 2) comprises only plane faces connected by curved regions. It presents a section in the form of a lying T which can theoretically be subdivided for functional reasons and for purposes of description into three parts, designated A, B and C. Part A which corresponds to the short limb of the 'T' has a polygonal section. It foreshadows the shape of the foot (pa) of the finished rail. The limb of the 'T' can be subdivided into a central part B, of substantially rectangular section, adjoining the part A, and a part C adjoining the part B of trapezoidal section bevelled on its free side. The profile of the primary blank 1 is symmetrical with regard to a horizontal plane represented by the intersection YY' on the plane of the section of the primary blank 1. The plane and its intersection YY' called hereinafter respectively the plane and axis of symmetry YY', are likewise the plane and axis of symmetry of the section of the bloom (a) and of the finished rail. The part A of the primary blank 1 is the only one which has been slightly preformed. It comprises five, preferably plane faces. Two faces are parallel to the plane of symmetry YY', one being perpendicular. The planes that contain the two other faces are secant on the same line. The part B, which is not pre-shaped, comprises two faces preferably plane and parallel to the plane YY'. If we compare these with the corresponding parts of the single blank (b) of the prior art, the part B has a thickness which is only slightly different from that of the bloom (a) and even less than that of the part A.

The part C comprises a preferably plane face, perpendicular to the plane YY' and two inclined plane faces with the planes that contain them meeting on the same line of the plane YY' on the free end of the part C. Thereby, the thickness of this part C, which is identical to that of the part B at the interface of the two parts, diminishes at a constant angle towards the free end of the part C. The shape given to the primary blank 1 is as close as possible to a rectangular shape compatible with the constraints associated with the metal flow at the time of consecutive universal rolling. In contrast to the single blank (b) of the prior art, for the primary blank 1 of the invention, the variation in thickness from one end to the other is practically always in the same way.

Figure 3:
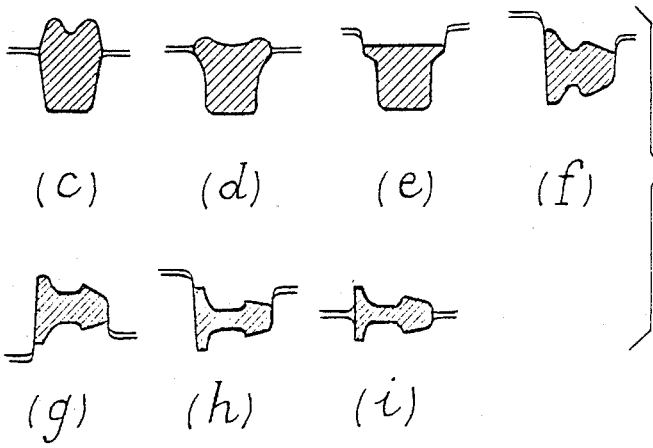
PRIOR ART FIG. 3

The primary blank 1 is formed in an open groove 2 of the invention, such as is shown in FIG. 4, from an eventually preformed bloom or an appropriate initial section (a), not shown. The bloom (a) can be obtained directly by continuous casting, or from an ingot. One of the considerable advantages of the primary blank 1 appears clearly with the comparison of the shaping of the single blank (b) (FIG. 3) to the primary shaping of the primary blank 1 (FIG. 4). Starting from a same bloom of appropriate section, a single groove is sufficient (groove 2) for forming the primary blank 1 of the invention, whereas 6 to 8 grooves are needed for forming the single blank (b) of the prior art. The primary blank 1 thus allows the suppression of six grooves, three of which are closed grooves that are subject to heavy wear. This reduction in the number of grooves has a considerable effect on the production cost and the capital investment of a rail rolling mill.

The reduction of the number of grooves—and above all the elimination of the closed grooves subject to heavy wear, such as grooves (f), (g) and (h) (FIG. 3)—allows a considerable reduction in the roll consumption per tonne of rail produced. The life of the groove 2 which is longer than that of the grooves (f) to (h), allows the rolling process to be carried on for longer periods and increases the life of the rolls. The increased roll life allows a reduction in the necessary roll inventory. The reduction of inventory can be optimised by accommodating in one set of rolls (or two sets of rolls according to circumstances) a greater number, and even all the grooves 2 for primary forming of the primary blanks 1 necessary for making the whole range of rails profiles produced by a rolling mill. When on a universal rail rolling mill having two two-high breakdown stands, one could, with very rare exceptions, only form the single blank (b) of a single rail profile, the invention can permit, depending on the barrel length of the rolls, the arrangement of a plurality of grooves 2 for forming the whole or the major part of the primary blanks 1 for all the rail profiles of the production range of the universal rail rolling mill. In addition, if one has taken the precaution of providing grooves for the reduction of the sizes of the initial bloom the rail mill can be fed with an initial bloom of any section, in particular it can be the same for a large number of rail profiles, which is a considerable advantage allowing the optimisation of the production upstream (ingot way or continuous casting). It is equally possible, for reasons of economy of production, to use only a single two-high stand for forming the primary blank 1. This single two-high stand, which does not have to be as expensive as a breakdown stand, can be, for example, an edging stand of the universal part of the rail-rolling mill, located preferably upstream of the first universal stand.

Figure 1:
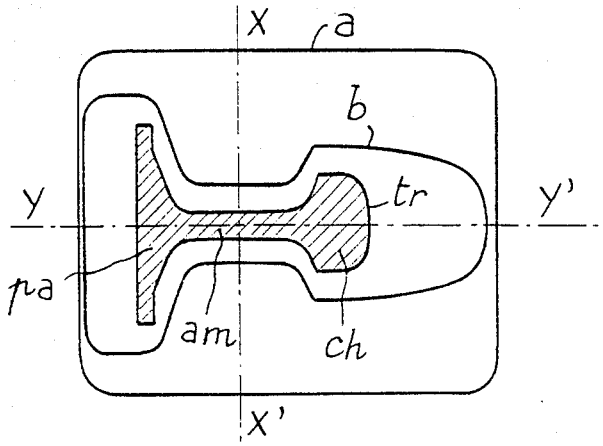
PRIOR ART FIG. 1
Figure 2:
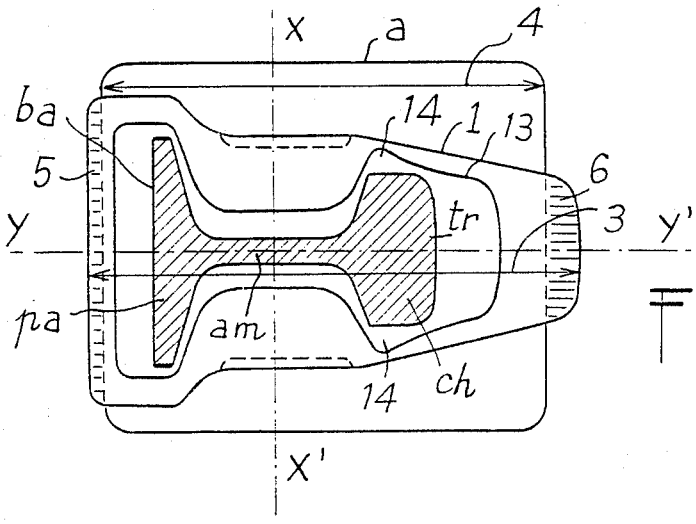

In the case of a new rolling mill, the necessary investment is considerably reduced by the elimination of a stand and its incidentals (motors, roller tables, space saved, etc). As the few indicated examples sufficiently show the solutions to be studied to derive the maximum economic advantage from the possibilities offered by the primary blank 1, it is not necessary to exhaustively enumerate all possible cases. The metallurgical advantages offered by the primary blank 1 are also worthy of mention. It permits the rolling of the metal exclusively by direct draught, which has not been the case up to now with the single blank (b). For metal produced from the ingots and for an unchanged overall reduction ratio, the primary blank 1 allows an improved forging effect because rolling is effected exclusively by direct draught. In addition, as is clearly seen from FIG. 2, as the height 3 of the primary blank 1 is greater than the largest dimension 4 of the bloom (a), the subsequent drafting of the parts that will become the head and the foot of the rail is stronger than in the prior art. As shown in FIG. 2, the horizontally hatched parts 5 and 6 of the primary blank 1 extend out of the profile of the bloom (a), in contrast to the single blank (b) of the prior art which is contained completely within the profile of the bloom (a). The primary blank 1 allows, when the overall reduction ratio is small (with continuous cast blooms), the reduced overall reduction ratio to be compensated for by the quality of drafting of the metal which is stronger and deeper forged, exclusively by direct draught, first, in the primary forming, then in the primary universal roughing and secondary forming phase of the invention, and finally in the universal rolling of the prior art.

The reduced number of passes necessary for its shaping and the massive and compact form of the primary blank 1 reduces the heat losses. The temperature is more homogeneous and the different parts of the primary blank stay hot longer. To facilitate the guiding of the primary blank 1 at its entry into the first universal pass, one can mark a shallow longitudinal imprint on each of the faces of the second part (B) of the primary blank 1.

As has been mentioned above, the invention equally improves constituting the second phase of the prior art universal rail rolling process. The first improvement relates to a primary universal roughing, the second to a non-universal open pass for secondary forming, of a new type, in universal rail rolling, inserted between the first improvement and the process of the prior art. The third improvement concerns a new form of blank, called secondary blank, intended for the universal rail rolling according to the prior art. The improvement of the second phase of the prior art universal rail rolling process comprises a primary universal roughing, carried out exclusively by universal passes, without edging passes. It differs in this from the teaching of the prior art which indicates that universal passes should alternate with edging passes.

Figure 7:
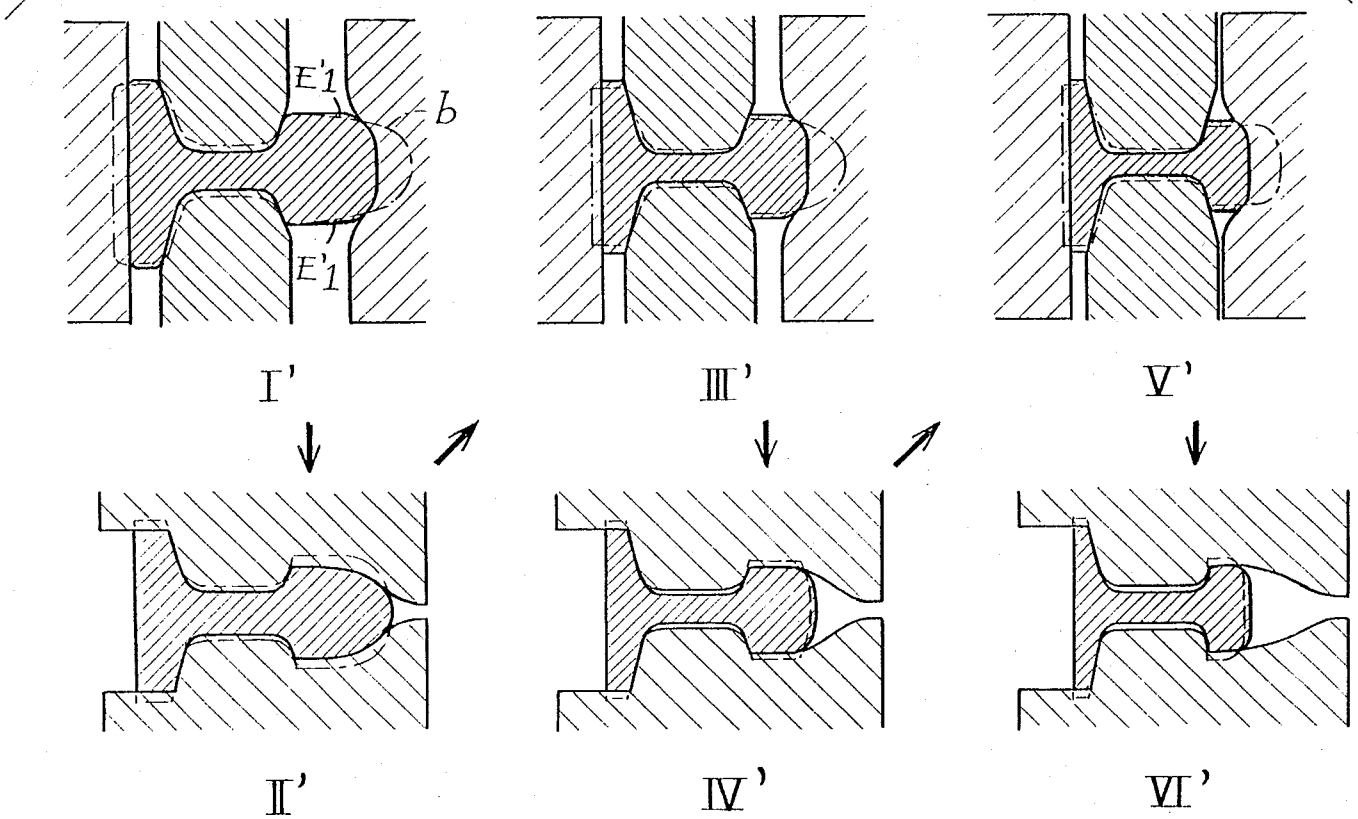
PRIOR ART FIG. 7
FIG. 7 shows schematically the sequence of universal rolling passes according to the prior art (the finishing pass not being shown).

FIG. 6 shows a sequence of three primary universal roughing passes according to the invention. The universal passes, made between the horizontal rolls 7 and 8 and the vertical rolls 9 and 10, working in the same plane, are numbered I to III and the order in which they are done is indicated by arrows. The profile of the bar that enters a pass is shown in dotted lines. That of the bar delivered by a pass is shown in solid lines and its section is hatched. The expansion $E_1$ produced on each side of the head after pass I of the invention is not suppressed by the following pass. It is, on the contrary, accentuated by the additional expansion $E_2$ in pass II of the invention. The expansion $E_3$ of pass III of the invention adds to the expansions $E_1$ and $E_2$. FIG. 7 shows, by way of comparison, the mixed universal and non-universal roughing of the prior art comprising a sequence of three prior art universal passs (passes I', III' and V'), each universal pass being followed by a non-universal edging pass (passes II', IV' and VI'). The expansion effected on the sides of the head after each universal pass is suppressed by the edging pass that follows it. The dotted and solid lines and the hatching have the same significance as in FIG. 6. The expansion $E'_1$ produced by the pass I' of the prior art is suppressed by the pass II' which follows it and so on. One of the principles of the primary universal roughing of the invention is to ensure the maximum reduction of the metal by direct draught along the axis YY' (FIGS. 2 and 5), in the parts C and A of the primary blank 1 that will form respectively the head and foot of the rail. The foot and the head which suffer the most in track will thus be better forged by direct draught with strong reductions applied along the axis of the profile that is subjected to most of the hardship when the rail is in track.

Figure 8:
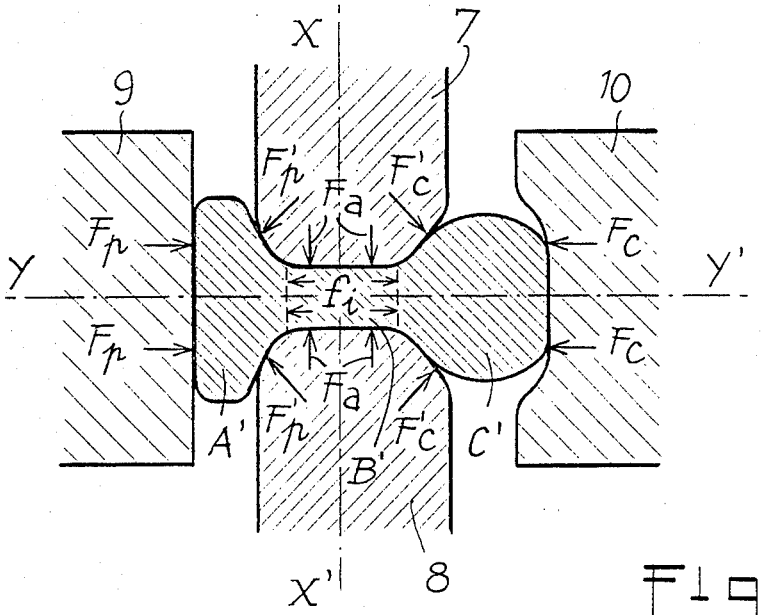
FIG. 8 shows schematically a primary universal roughing pass according to the invention with the indication of the forces applied to and within the primary blank 1.

The web of the rail is formed by direct draught along the axis XX'. FIG. 8 shows the section of the bar exiting from a pass of the primary universal roughing. The section of the bar is for purposes of explanation subdivided into part A', B' and C' which originate from parts A, B and C of the primary blank 1 and which will form respectively the foot, the web and the head of the finished rail. The forces exerted on the bar by the vertical and horizontal rolls are designated respectively by $F_p$, $F_a$ and $F_c$ when they are applied to the foot, web and head parts of the bar. According to the invention one has given to the Part B of the primary blank a breadth which will be practically that of the web of the bar during pass I (FIG. 6) of the invention. According to the invention, the formation of the web by direct draughts exerted by the forces $F_a$ (FIG. 8) along the axis XX' is done without broadening of the web, that is to say of the part B'. The formation of the web by direct draughts exerted by the forces $F_a$ along the axis XX' develops, at the interfaces of the part B' with the parts A' and C', the forces ($f_i$) and the metal flows which oppose the effect of the forces $F_c$ and $F_p$ in the parts C' out of the imprint of the horizontal rolls. Further the sides of the horizontal rolls exert the forces $F'_c$on the head and $F'_p$ on the foot. The formation of the part C of the primary blank 1, and more particularly of the sides ($f_c$) of the head, of the tread ($t_r$) and of the surfaces that connect them is done by a new profile given to the active part of the vertical roll 10 located on the head side. One gives (FIG. 9) to the active part of the vertical roll 10 on the head side a curvature such that it promotes, starting from the successive points of attack Poa 1, Poa 2, Poa 3 (FIG. 10) of the primary blank 1 by the vertical roll 10, the expansions $E_1$, $E_2$, $E_3$ (FIG. 6) of the sides of head.

Figure 9:
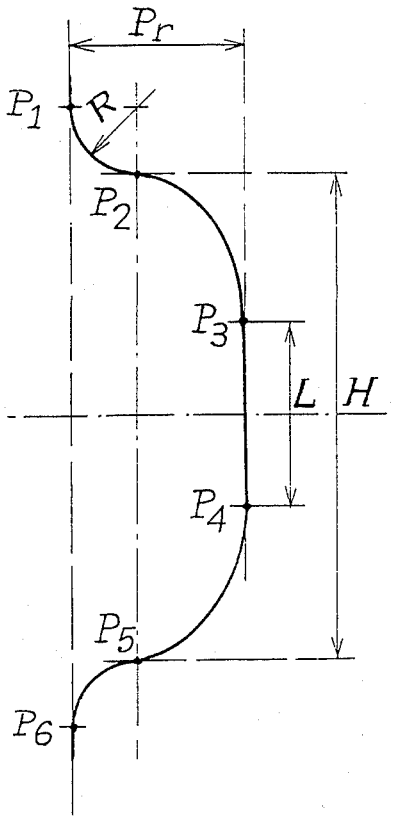
FIG. 9 shows schematically the profile according to the invention of the active part of the vertical roll on the head side.
Figure 10:
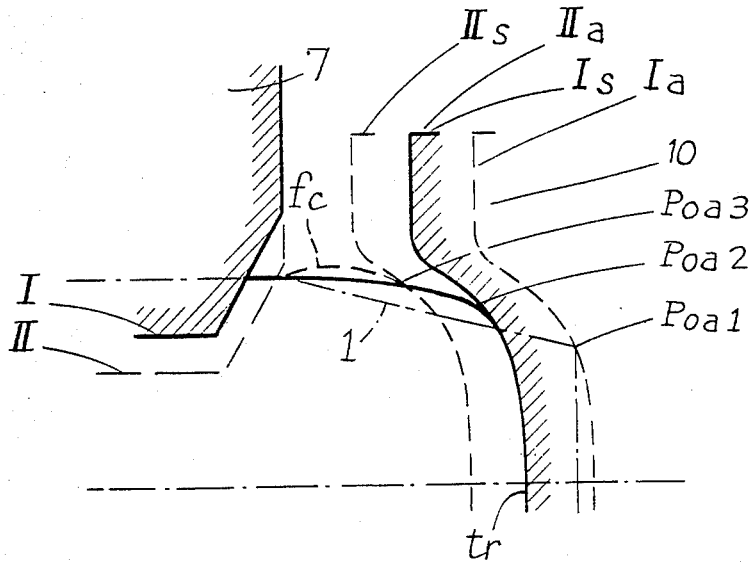
FIG. 10 shows schematically and partially a part of the upper horizontal roll, a portion of the primary blank 1 and a portion of the head of the rail in the position of attack a and of exit s of passes I and II of universal primary roughing of the invention.
Figure 11:
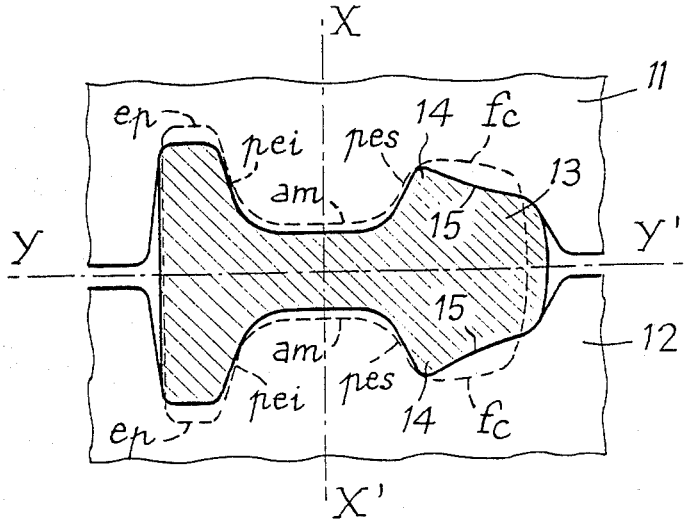
FIG. 11 is a view to a larger scale of the view of pass IV of the secondary forming of the invention shown in FIG. 6.

The curvature of the active part of the vertical roll 10 on the head side presents therefor a profile $P_1$ and $P_2$ $P_3$ $P_4$ $P_5$ $P_6$ which is defined by one or a plurality of polynomial shapes that favour the plastic flow of the metal (FIG. 9). In one embodiment, the polynomial form can be such that it corresponds to the branch $P_2$ $P_3$ of the cubic parabola of the solid of equal resistance inscribed in the depth $P_r$ of the groove of the vertical roll 10 less the radius R of the outer edge of the groove and in the half height $$\frac{H}{2}$$

of the groove less the flat bottom part $P_3$ $P_4$ of the vertical roll 10. The profile of the vertical roll 10 being symmetrical with respect to the axis YY', it goes without saying that the above definition applies equally to the other half of the profile, namely $P_3$ $P_4$ $P_5$ $P_6$. FIG. 10 shows the vertical roll 10 and the part C of the primary blank 1 during pass I, Poa 1 being the point of attack of the roll 10 on the primary blank 1, Poa 2 being the exit point where the roll 10 separates from the side ($f_c$) of the head. Note that for pass II the point Poa 2 becomes the point of attack and Poa 3 will be the point of separation and so on. The positions of the horizontal roll 7 are also indicated. Another object is to prevent the formation of sharp ridges on the connecting surfaces. The rail issuing from the last pass of the primary universal roughing is rolled between two horizontal rolls, upper 11 and lower 12 (FIG. 6 pass IV), of which only the active part is shown. Pass IV of the invention is not an edging pass as passes II' and IV' and VI' of the prior art (FIG. 7). The rail here is rolled throughout its section with srong reduction, by direct draught perpendicularly to the plane YY' so that particularly the free parts that have not been rolled in the preceding universal passes I, II and III, free parts (FIG. 11) such as the sides of the head ($f_c$), the extremities of the foot ($e_p$), the upper (pes) and lower (pei) fishing slopes and their connecting parts, should be submitted to a strong forging action.

At this stage, the profile obtained at pass IV should present very good characteristics of symmetry with respect to the plane YY', of balance of the two halves of the foot and head parts, that is to say the general form defined for the universal rolling operations of the prior art according to French Pat. No. 1 447 939. This secondary blank 13 (FIG. 11) of the invention thus prepared is characterised by swellings 14 located between the upper fishing slopes (pes) and the sides ($f_c$) of the head, as well as by a concave form 15 of the sides of the head. The swellings and this concave form constitute a reserve of metal which, maintained and reduced by the action of the edging passes II', IV' and VI', will permit the precise shaping of the profile of the finished rail on the sides of the head, the upper fishing slopes and their connecting radii during the finishing pass.

What is claimed is:

1. A method of forming a primary metallic blank for a rail comprising the steps of:

(a) forming a bloom having a cross-section of generally rectangular configuration with a predetermined height and width; and, (b) passing the bloom through only open grooves to form a primary blank having a cross-section generally symmetrical about a plane extending parallel to the longer dimension of the cross-section of the bloom, the cross-section having first, second and third sections wherein:

(i) the first section has five plane faces, two extending parallel to the plane of symmetry and defining the height of the portion; a second extending perpendicular to the plane of symmetry and interconnecting the two parallel faces; and two extending from the two parallel faces and converging toward the plane of symmetry;

(ii) the second section has two plane faces extending from the two convergent faces of the first section generally parallel to the plane of symmetry; and, (iii) the third section has three plane faces, two extending from the two faces of the second section and converging toward the plane of symmetry and a third face extending generally perpendicular to the plane of symmetry interconnecting the two convergent faces.

2. The method according to claim 1 wherein the bloom is formed from a cast ingot.

3. The method according to claim 1 wherein the bloom is formed by continuous casting.

4. The method according to claim 1 wherein the maximum height of the third section of the primary blank is no greater than the height of the second section.

5. The method according to claim 4 wherein the maximum height of the second and third sections is less than the maximum height of the first section.

6. The method according to claim 5 comprising the additional step of forming a lengthwise groove on each face of the second section to guide the blank during subsequent rolling.

7. The method according to claim 1 wherein the passing of the bloom through the open grooves forms the primary blank with a width greater than the width of the bloom.

8. A primary blank formed from a bloom for subsequently forming a rail, wherein the primary blank has a cross-section that is symmetrical about a plane and comprises:

(a) a first section having five plane faces, two extending parallel to the plane of symmetry and defining the height of the portion; a second extending perpendicular to the plane of symmetry and interconnecting the two parallel faces; and two extending from the two parallel faces and converging toward the plane of symmetry;

(b) a second section having two plane faces extending from the two convergent faces of the first section generally parallel to the plane of symmetry; and, (c) a third section having three plane faces, two extending from the two faces of the second section and converging toward the plane of symmetry and a third face extending generally perpendicular to the plane of symmetry interconnecting the two convergent faces.

9. The primary blank according to claim 8 wherein the maximum height of the third section is no greater than the height of the second section.

10. The primary blank according to claim 9 wherein the maximum height of the second and third sections is less than the maximum height of the first portion.

11. The primary blank according to claim 8 wherein the faces of the second section have longitudinal grooves formed therein to guide the blank during subsequent forming operations.

12. A method of forming a secondary metallic blank for a rail comprising the steps of:

(a) forming a bloom having a cross-section of generally rectangular configuration with a predetermined height and width;

(b) passing the bloom through only first open grooves to form a primary blank having a cross-section generally symmetrical about a plane extending parallel to the longer dimension of the cross-section of the bloom, the cross-section having first, second and third sections wherein:

(i) the first section has five plane faces, two extending parallel to the plane of symmetry and defining the height of the portion; a second extending perpendicular to the plane of symmetry and interconnecting the two parallel faces; and two extending from the two parallel faces and converging toward the plane of symmetry;

(ii) the second section has two plane faces extending from the two convergent faces of the first section generally parallel to the plane of symmetry; and, (iii) the third section has three plane faces, two extending from the two faces of the second section and converging toward the plane of symmetry and a third face extending generally perpendicular to the plane of symmetry interconnecting the two convergent faces;

(c) passing the primary blank through a plurality of universal passes between two vertical and two horizontal rolls without intervening edging passes such that the horizontal rolls reduce the distance between the two plane faces of the second section and the two vertical rolls apply direct pressure against the perpendicular faces of the first and third sections such that metal from the second section moves internally towards the first and third sections and from the perpendicular faces of the first and third sections toward central portions of these sections, respectively, to breakdown the internal solidification structure of the metal and to cause the convergent faces of the third section to expand away from the plane of symmetry; and, (d) subsequently passing the blank through second open grooves to form the secondary blank.

13. The method according to claim 12 wherein the vertical roll acting on the perpendicular face of the third section forms this face into a curved profile.

14. The method according to claim 13 wherein the curve of the profile is defined by a polynomial shape that favors the plastic flow of the metal.

15. The method according to claim 14 wherein the polynomial shape corresponds to a branch of a cubic parabola defined as a function of the depth and width of the groove in the vertical roll.

16. The method according to claim 13 wherein said second open grooves shape all sections of the blank.

17. The method according to claim 16 wherein said second open grooves form the third section so as to have concave convergent faces and enlarged portions adjacent the juncture with the second section.

18. The method according to claim 17 wherein the bloom is formed from a cast ingot.

19. The method according to claim 17 wherein the bloom is formed by continuous casting.

* * * * *